US005568694A

United States Patent [19]

Capra et al.

[11] Patent Number: 5,568,694

[45] Date of Patent: Oct. 29, 1996

[54] BEHIND THE BUMPER, QUICK ATTACHMENT SYSTEM AND MECHANISM FOR TRUCK MOUNTED SNOW PLOWS

[75] Inventors: Lawrence Capra, Iron Mountain; Philip J. Quenzi, Atlantic Mine, both of Mich.

[73] Assignee: M. J. Electric, Inc., Iron Mountain, Mich.

[21] Appl. No.: 167,341

[22] Filed: Dec. 15, 1993

[51] Int. Cl.[6] ..... E01H 5/04

[52] U.S. Cl. ..... 37/231; 37/236; 37/270

[58] Field of Search ..... 37/231, 232, 233, 37/234, 235, 236, 266, 270, 271; 403/321, 324, 322

[56] References Cited

U.S. PATENT DOCUMENTS

| | | | |
|---|---|---|---|
| 3,150,884 | 9/1964 | Drott | 37/231 X |
| 3,410,008 | 11/1968 | Standfuss | 37/231 |
| 3,412,489 | 11/1968 | Klapprodt et al. | 37/231 |
| 3,987,562 | 10/1976 | Deen et al. | 37/232 X |
| 4,074,448 | 2/1978 | Niemela | 37/234 |
| 4,619,060 | 10/1986 | Knowlton | 37/231 |
| 4,833,799 | 5/1989 | Harte et al. | 37/231 |
| 4,962,599 | 10/1990 | Harris | 37/235 X |
| 5,082,065 | 1/1992 | Fletcher | 37/231 X |
| 5,195,261 | 3/1993 | Vachon | 37/236 X |
| 5,353,530 | 10/1994 | Pieper | 37/271 X |

*Primary Examiner*—David H. Corbin

*Assistant Examiner*—Victor Batson

*Attorney, Agent, or Firm*—Jim Zegeer

[57] ABSTRACT

A quick hitch-unhitch attachment for mounting a snow working implement on a vehicle, comprising a vehicle mount attachment (VMA) frame secured to the vehicle, has a pair of spaced sockets which are positioned below and behind the vehicle bumper when mounted on the vehicle. A first pair of reaction bearing surfaces are aligned with and to the rear of the spaced sockets and a transverse latch bar means extends transversely of the sockets. An intermediate support frame has a rearward end with a pair of latching arms extending in a rearward direction and in general alignment with the sockets, respectively. Each latching arm has a further reaction bearing surface for bearing against respective ones of the first pair of reaction bearing surfaces. A support frame has a forward end attached to the snow working implement and a rearward end pivotally connected to the intermediate frame for rotation about a horizontal axis. A latching mechanism on the intermediate support frame for positioning a latch member rearwardly of the transverse latch bar. A lift mechanism on the intermediate support frame pivots the support frame about the horizontal axis and lifts the support frame and working implement off the ground such that the weight thereof is borne by the reaction bearing surfaces and the pair of spaced socket means. A friction slide plate maintains the angular relationship between the intermediate frame and the support frame when the intermediate support frame is not coupled to the VMA frame.

16 Claims, 9 Drawing Sheets

BEHIND THE BUMPER, QUICK ATTACHMENT SYSTEM AND MECHANISM FOR TRUCK MOUNTED SNOW PLOWS

REFERENCE TO RELATED PATENTS

This invention is an improvement on the snow plow disclosed and claimed in Quenzi U.S. Pat. No. 4,658,519, which is incorporated herein by reference.

BACKGROUND AND BRIEF DESCRIPTION OF THE INVENTION

Numerous devices have been proposed in the past for detachably mounting a snow plow to the front of a vehicle, such as a truck. For the most part these require some vehicle attachment structure either to the bumper or have frame members such as a lift tower and light bar assembly which project in front of the bumper or, have a lift tower mechanism projecting upwardly between the bumper and the front grill of the vehicle. In most of these arrangements, the attachment structure remains on the vehicle during normal use (e.g., during non-plowing operations when the plow and its support frame are stored), and they, in effect, disable or in part disable the shock absorbing properties of the bumper and the operation of the bumper in actuating air bag deployment and the like. In addition, these attachment structures are generally unsightly and sometimes dangerous. In most cases, the prior art systems require fairly precise alignment (both vertically and horizontally) of parts on the plow itself and vehicle mounted parts during the attachment procedure. Very often, it requires two persons, one to drive the vehicle and, the other to either lift and make the alignment as the vehicle approaches to align the plow and the vehicle.

In addition, some recent mounting arrangements which seek to solve the bumper problems require a three-point connection to the vehicle, typically two spaced at a lower level below the bumper and one (or more) spaced above the bumper for connecting a lift mechanism to the plow frame to allow the frame to be lifted for transportation purposes. Moreover, such systems do not allow for slight horizontal and vertical misalignments between the attachment components permanently mounted on the vehicle and complementary attachment components on the plow support frame.

The present invention solves the above problems by providing a two-point coupling and suspension system in which a vehicle mounted attachment frame is secured to the frame of the vehicle and has a pair of spaced sockets which are positioned below and slightly behind the forward-most end surface of vehicle bumper when the vehicle mount attachment frame is mounted on the vehicle. The sockets include a first pair of reaction bearing surfaces aligned with and to the rear of the spaced sockets and a transverse latch bar forward of the reaction bearing surfaces. An intermediate support frame has a pair of rearwardly extending latching arms which extend in a rearward direction and have further reaction bearing surfaces for bearing against the respective ones of the first pair of reaction bearing surfaces when the plow has been lifted. The sockets have diverging plates which guide the rearwardly extending latching arms and thus horizontally aligns the arms with their respective sockets. Camming surfaces on the rearwardly extending latching arms engage a transverse latch bar and correct for vertical misalignments.

A support frame for supporting snow plow blade means has a rearward end pivotally connected to the intermediate frame for rotation about a horizontal axis. A lift mechanism is coupled between the intermediate support frame and the support frame for pivoting the support frame about the horizontal axis and for lifting the support frame and working implement off the ground such that the weight thereof is borne by the reaction bearing surfaces and the said pair of spaced socket means. One or more latch dogs are rotated by an over-center toggle linkage to lock the latch arms in their respective sockets.

In one preferred embodiment, the lift mechanism incorporates a pair of laterally spaced hydraulic lift cylinders. In a further preferred embodiment, the hydraulic lift cylinders are single acting and, in another embodiment, the lift cylinders are double-acting. In the case of single acting lift cylinders (or double acting cylinders operated as a single acting cylinder), hydraulic fluid is admitted to one side of the piston to force the piston towards the opposite end. Springs or the weight of the load system return the piston to the opposite end when the hydraulic pressure is released. In a further preferred embodiment, the hydraulic pressure is applied to both sides of the hydraulic piston head to positively drive it in both directions. This latter embodiment is very useful when it is desired to pack the snow or otherwise handle the snow more efficiently. The double-acting lift cylinder arrangement provides a capability to obtain pressure on the plow when using the appropriate control valve and is desirable for cutting matte or ice build-up and for stacking the snow.

In a further embodiment, instead of a pair of side-mounted hydraulic cylinders, a single acting hydraulic lift cylinder is centrally positioned on the coupler assembly upright members and a projecting arm is actuated in a vertical plane. A chain, coupled to the center of the projecting arm and to the plow support frame operates in a conventional fashion to pivot the frame about the horizontal pivot.

While in the preferred embodiment the plow blade support frame is a "T"-frame as disclosed in the above-referenced Quenzi patent, and the blade is constituted by a pair of centrally hinged plow blades, it will be appreciated that the plow blades may be constituted by a single blade. Moreover, while the blades are positioned using hydraulic cylinders, equivalent electrical or manual blade positioning or angle adjusting mechanism may be employed. In addition, while the "T"-frame of the above-reference Quenzi patent is preferred, an "A"-frame or other frame system may be used as the plow blade support and load transmitting frame.

A further feature of the invention is the provision of a friction mechanism so that the angle between the intermediate support frame and the support frame is maintained when the plow is rested on the ground for disengagement from the truck. In accordance with this feature, a support strap or slide bar is pivotally mounted on one of the plow support frame or intermediate frame and is provided with an elongated slot. The slotted portion of the slide bar is clamped between two pieces of plastic material (UHMW polyethylene or equivalent) with sufficient force to hold the weight of the components when the snow plow is off the truck but not so tight as to prevent lifting of the plow with one or more lift cylinders. This holds the coupler and the power unit and light bar assembly in position relative to the frame when the plow is off the truck and thus provides for easy one- person attachment of the plow to the truck since the projecting ends of the intermediate coupling unit are generally aligned with the truck when the plow blades have been lowered to the ground for storage or disengagement purposes.

DETAILED DESCRIPTION OF THE DRAWINGS

Figure 1:
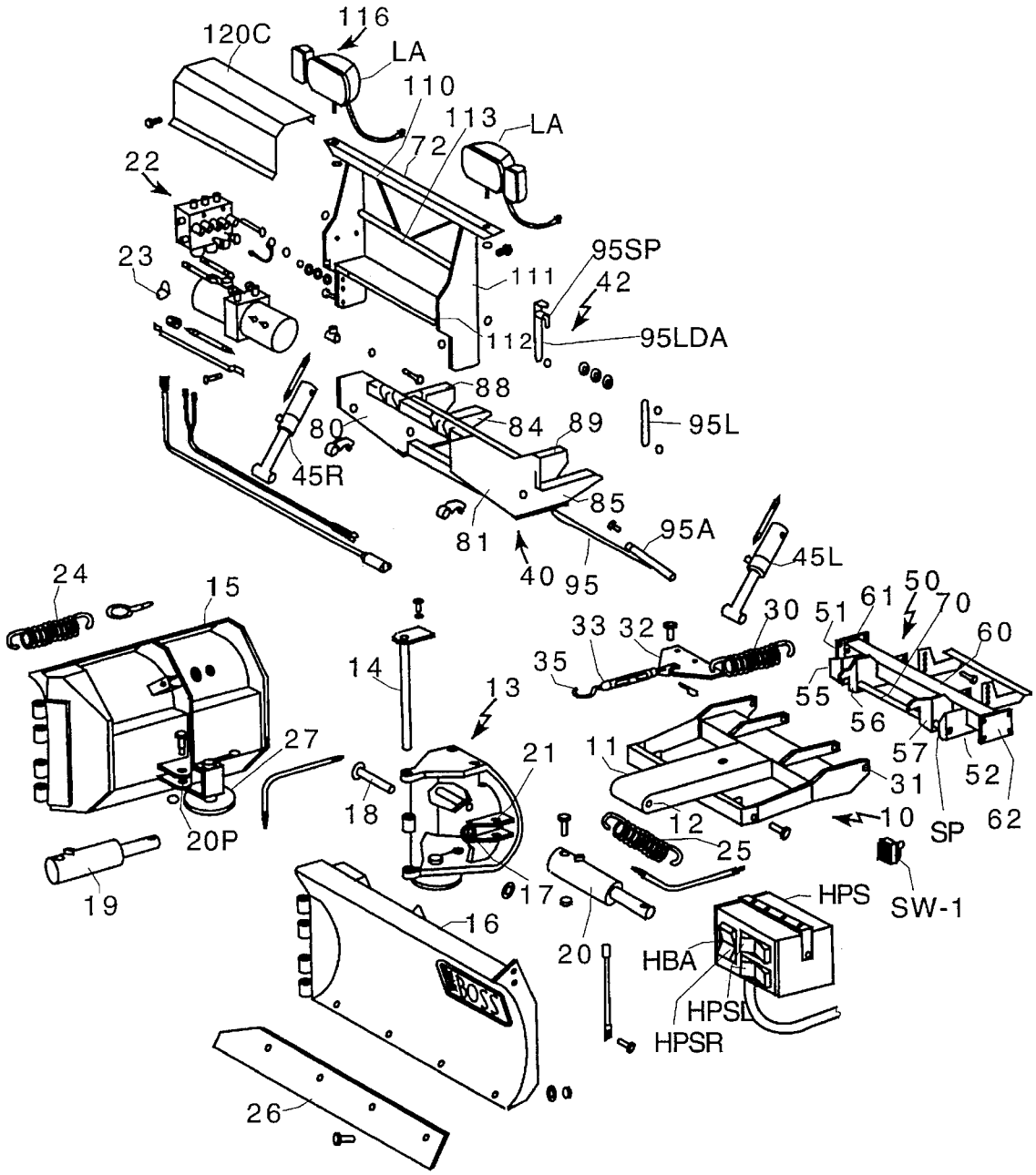
Figure 2A:
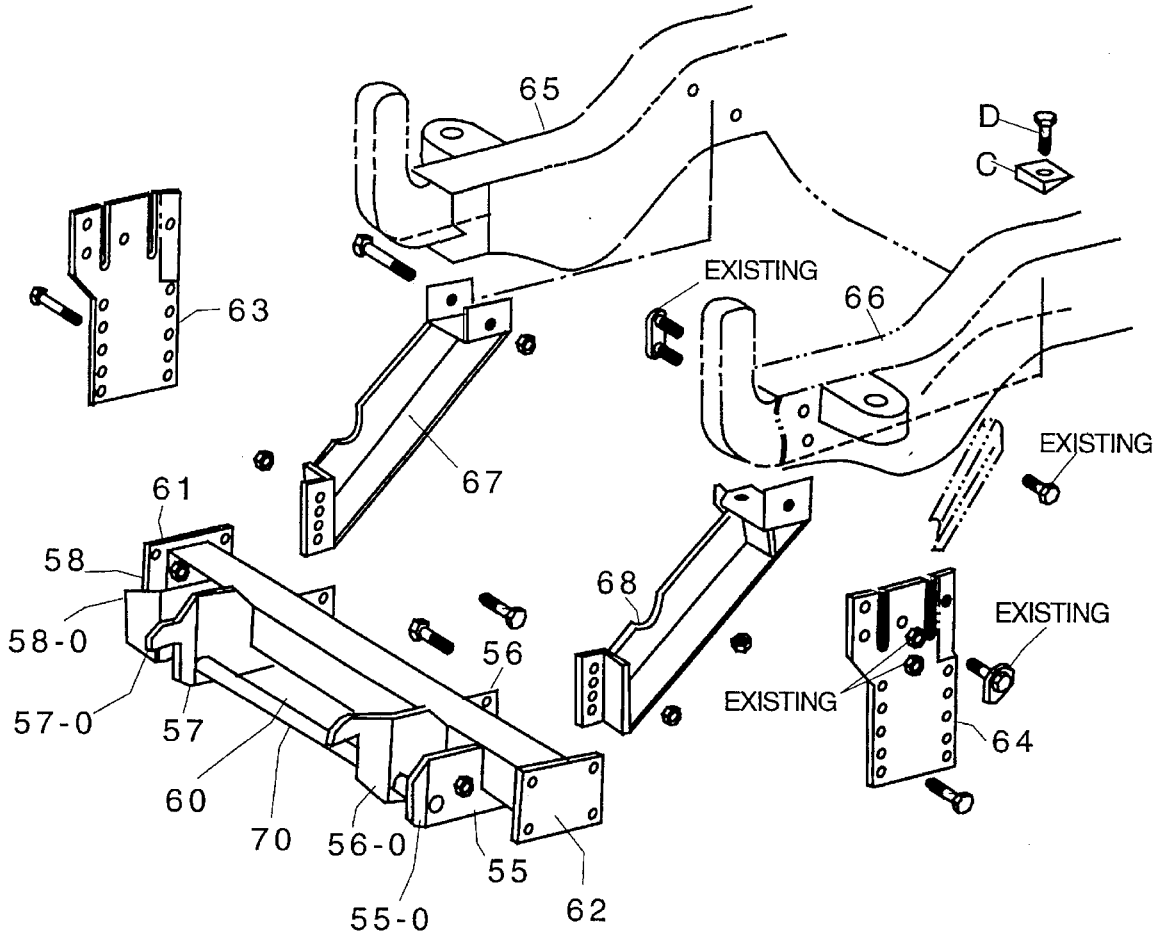
Figure 2B:
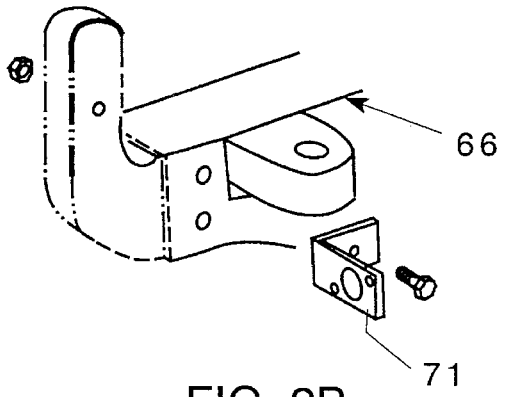
Figure 3A:
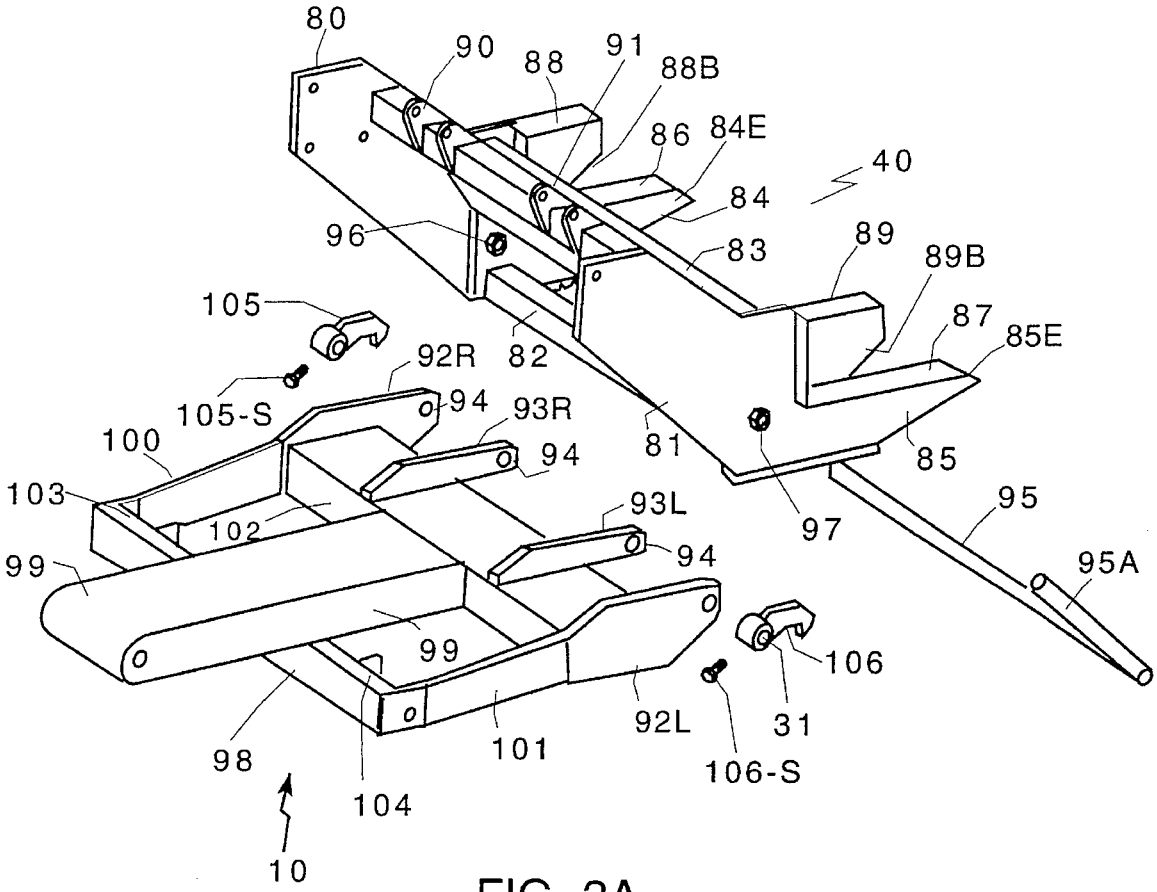
Figure 3B:
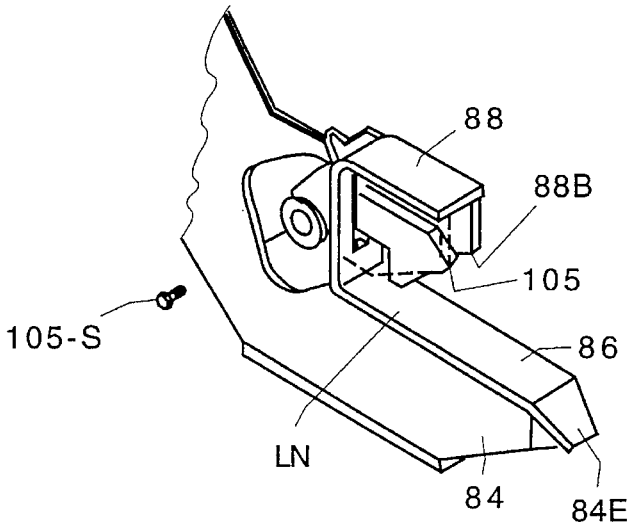
Figure 3C:
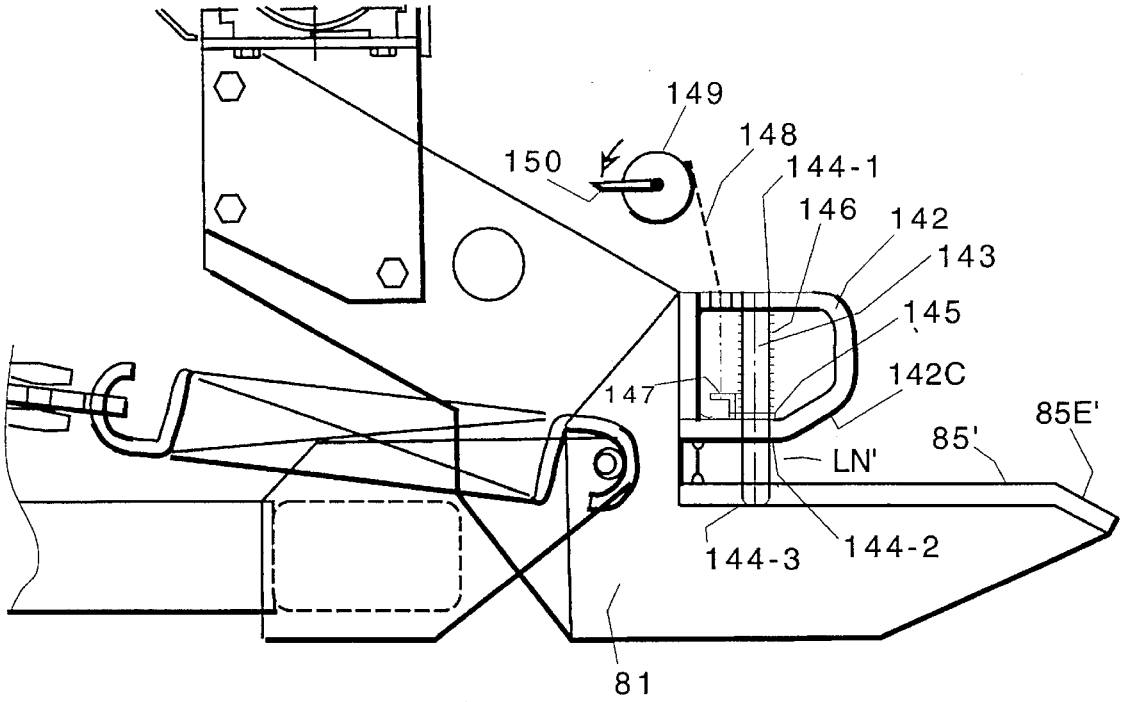
Figure 4:
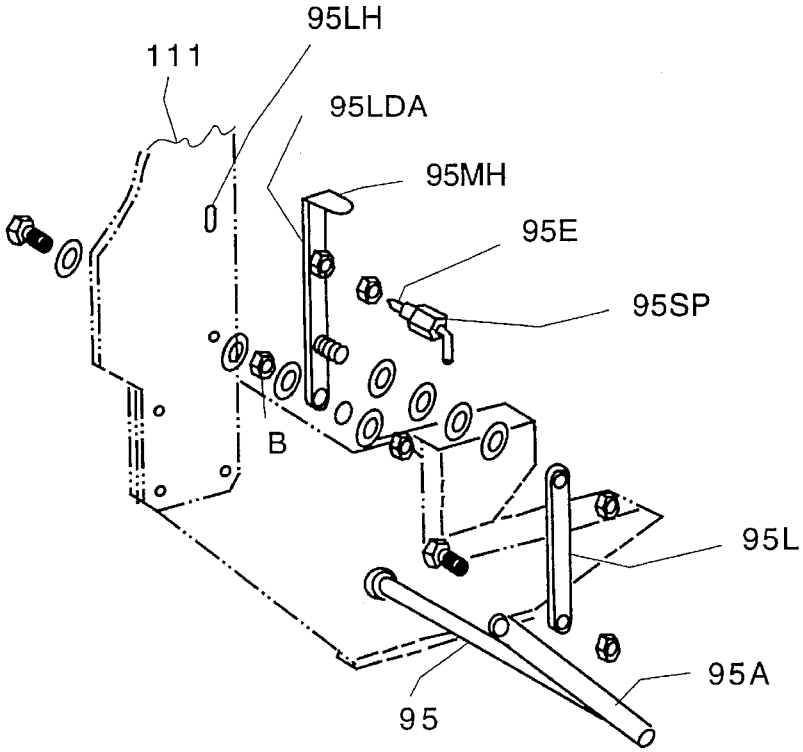
Figure 5:
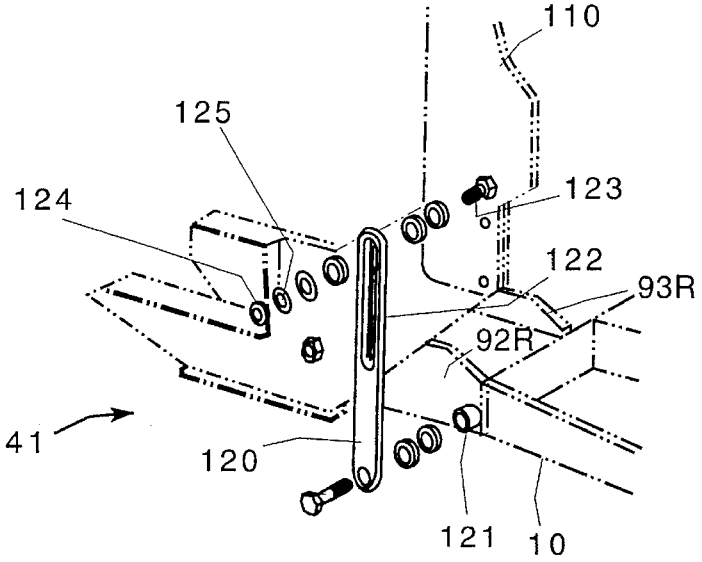
Figure 6:
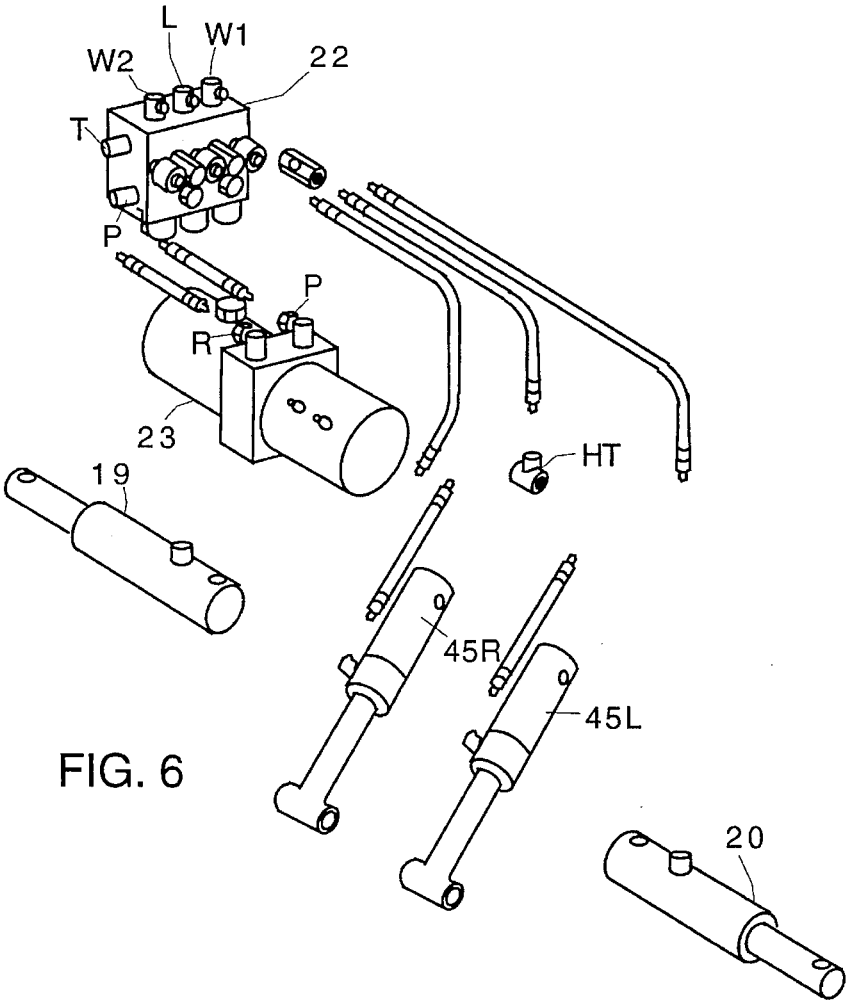
Figure 7:
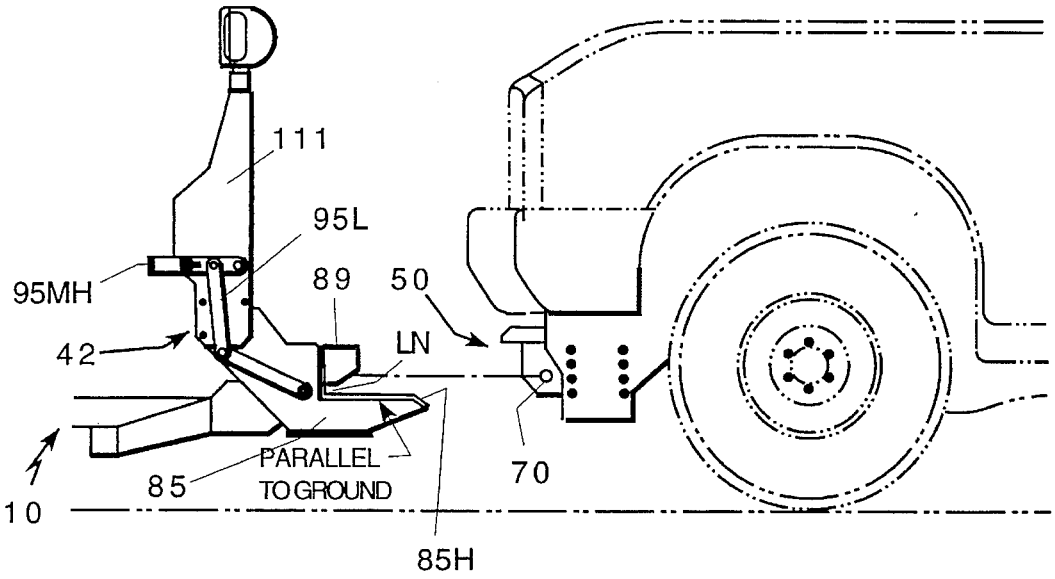
Figure 8:
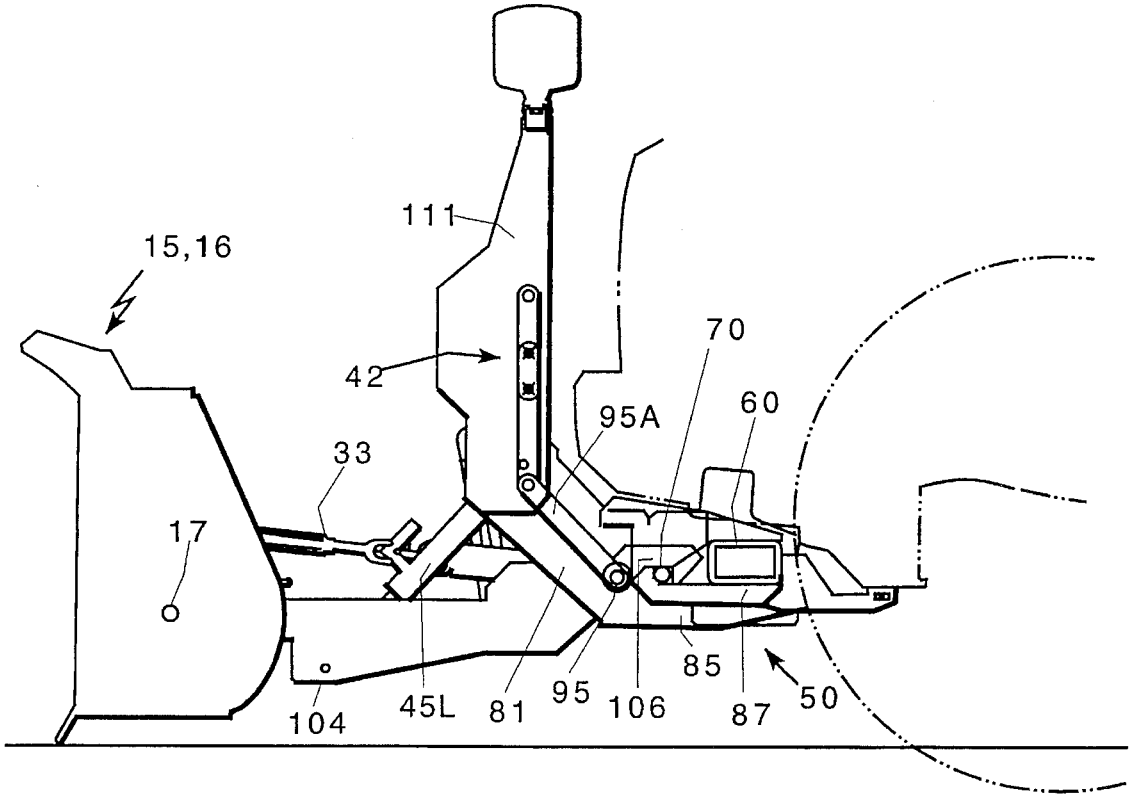
Figure 9A:
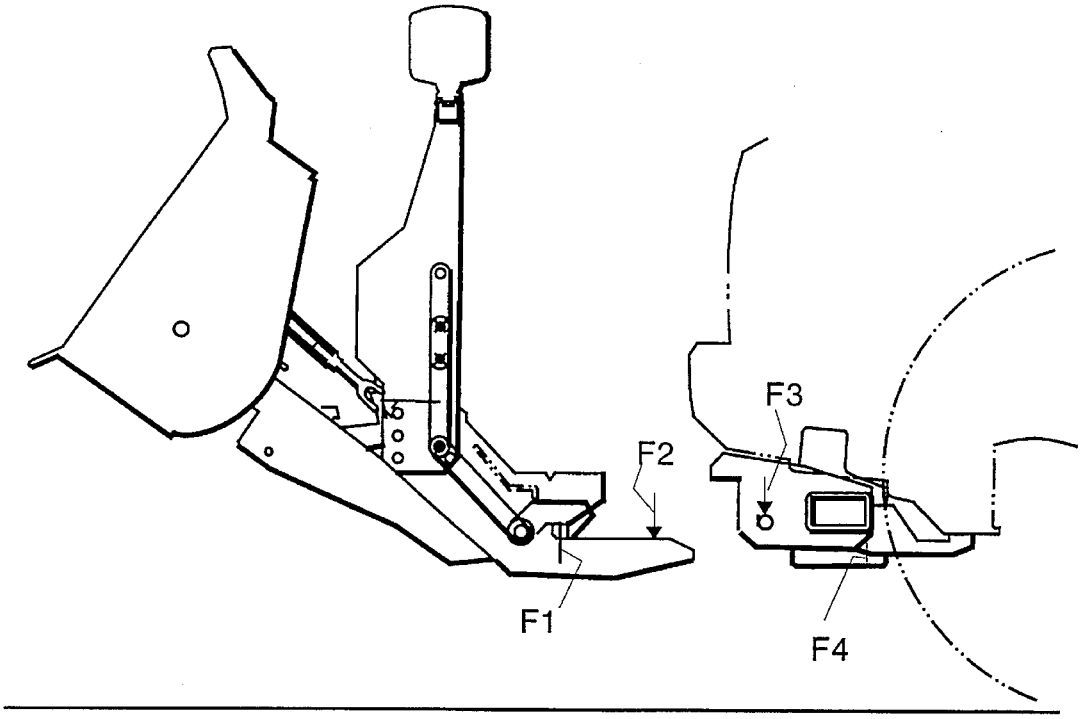
Figure 9B:
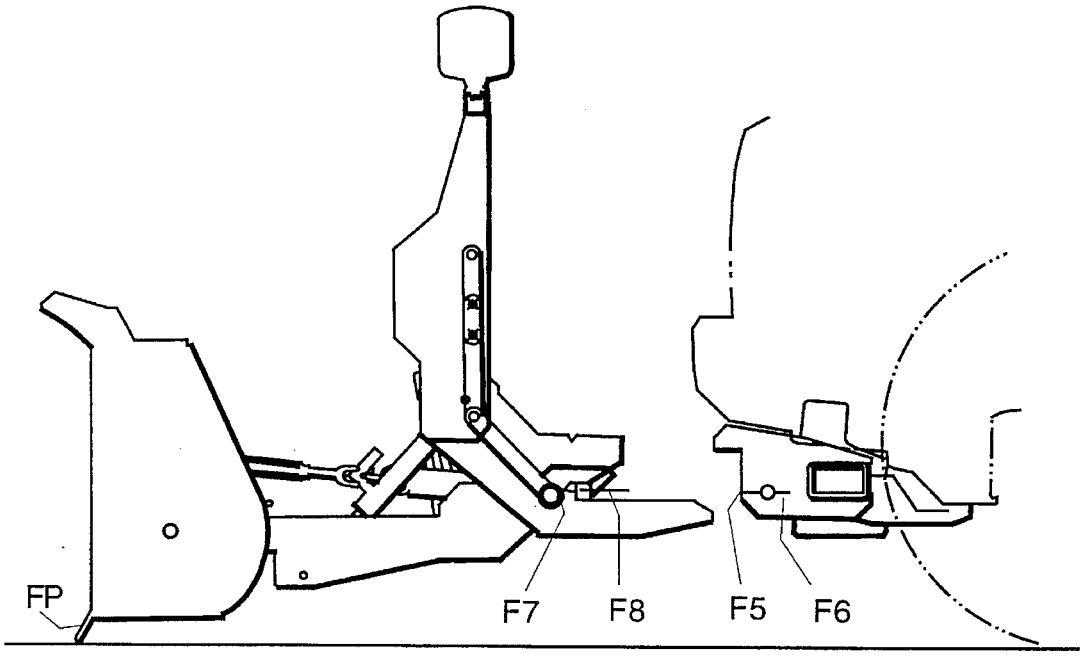
Figure 9C:
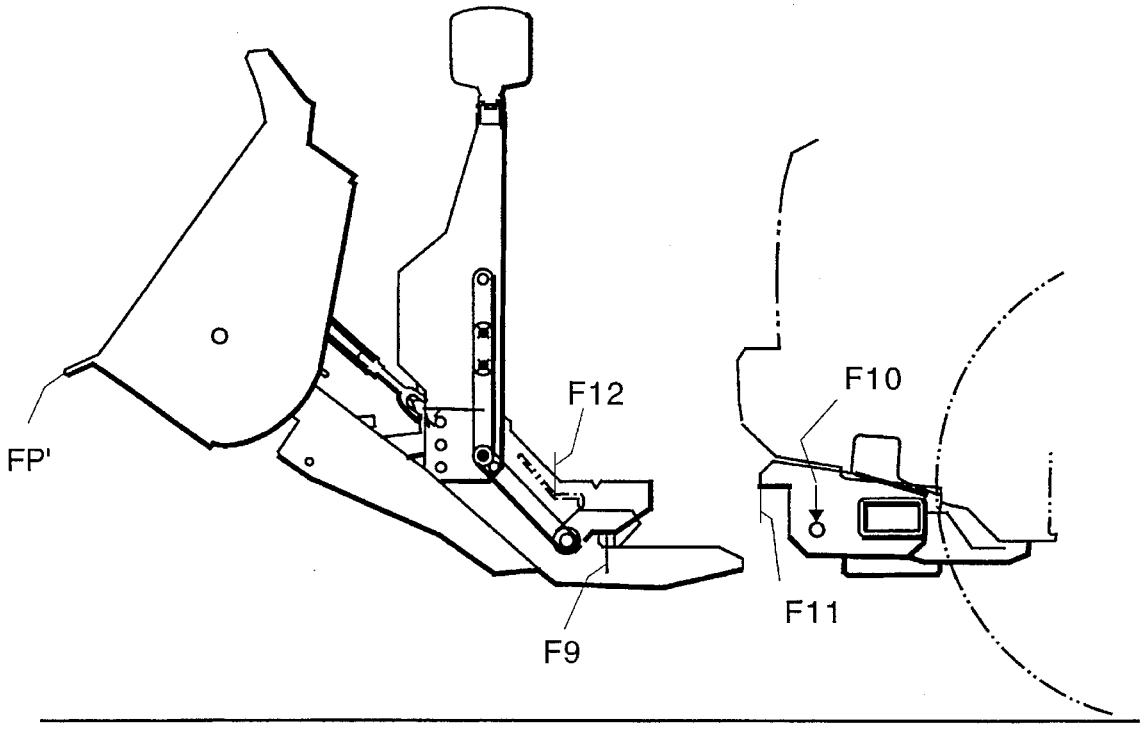
Figure 10:
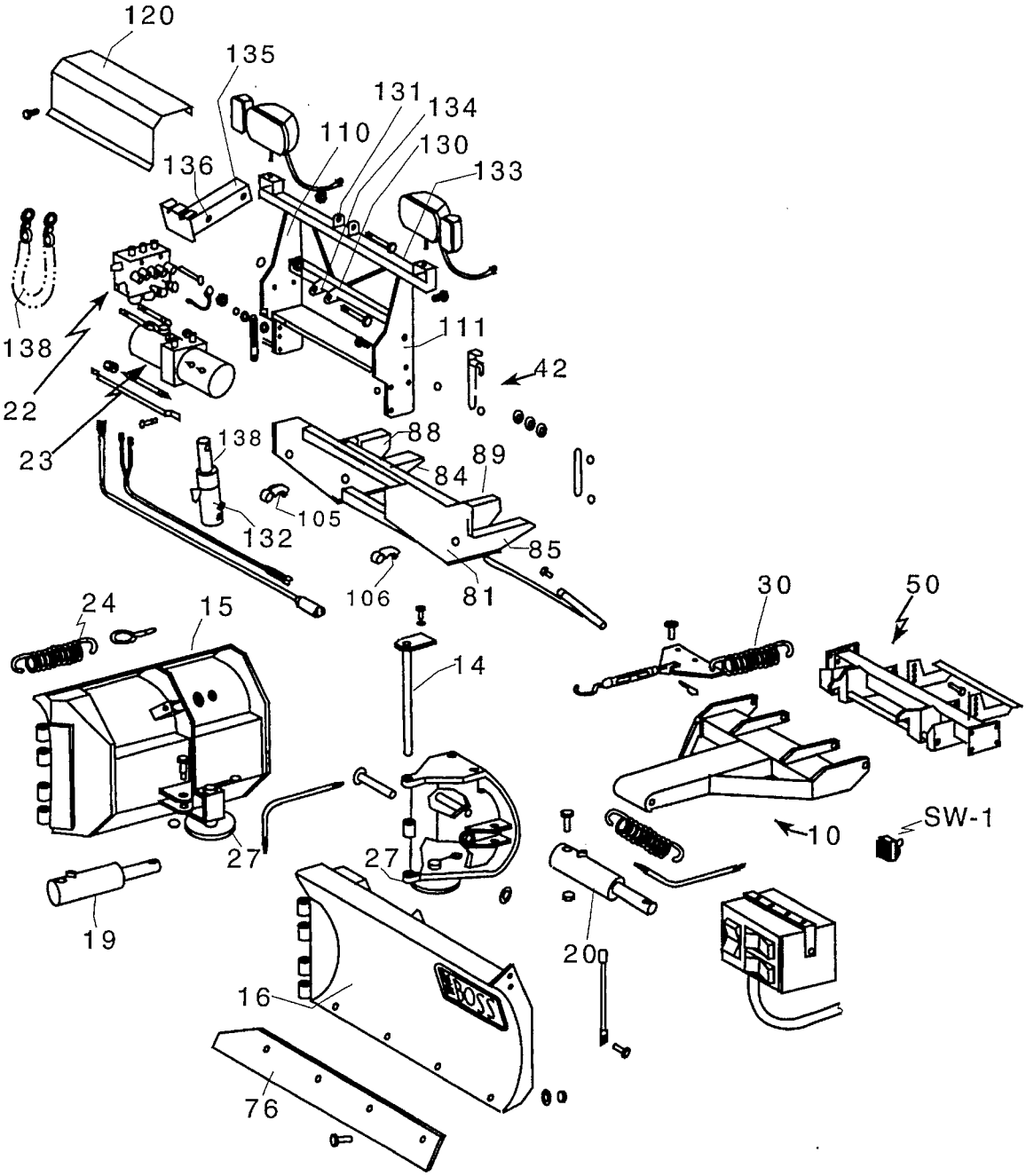

The above and other objects, advantages, and features of the invention will become more apparent when considered with the accompanying specification and following drawings wherein:

FIG. 1 is an exploded perspective view of a snow plow system incorporating the invention, FIG. 2*a* is an exploded perspective view showing the vehicle mount attachment being attached to the exemplary frame horns of a truck, FIG. 2*b* shows where an electrical socket connector can be mounted, FIG. 3*a* is a partially exploded perspective view showing the intermediate attachment frame pivotal attachment of the plow support add load transmissive frame, FIG. 3*b* is a partial perspective view showing the latching dogs and the rearwardly projecting latching areas, FIG. 3*c* illustrates an alternate latching mechanism, FIG. 4 is an exploded view showing details of the latch dog operating linkage, FIG. 5 is an exploded view of the coupler side plate assembly for maintaining the coupler power unit and light bar assembly in position relative to the main frame when the plow is off the truck so as to not require operator intervention to reconnect, FIG. 6 illustrates the hydraulic system and components thereof, FIG. 7 is a side elevational view of the assembled unit showing the vehicle approaching for attachment purposes, FIG. 8 is a side elevation view showing the preferred embodiment of the plow coupled to the vehicle attachment support frame, FIGS. 9*a*, 9*b* 9*c* illustrations provided to demonstrate the positions of the reactive/reaction forces on the plow and truck with the plow in the raised position (FIG. 9*a*) when plowing forces are met (FIG. 9*b*) and when stacking snow the rebound forces are shown in FIG. 9*c*, FIG. 10 is an exploded isometric view of a further embodiment of the invention incorporating a conventional single centrally located chain lift cylinder.

DETAILED DESCRIPTION OF THE INVENTION

Referring to FIG. 1, a plow blade support frame 10 which, in this embodiment, is the "T"-frame disclosed in the above-referenced Quenzi patent, has a forward end 11 which is provided with a horizontal pivot 12 on which is pivotally mounted a cowling structure 13 carrying a vertical hinge pin 14, which pivotally mounts a pair of blades 15, 16 from the cowling 13. Cowling 13 is provided with a horizontal pivot 17 through which horizontal hinge pin 18 passes and pivotally connects the cowling 13 to the forward end 11 of "T"-frame 10. A pair of angle adjusting hydraulic cylinders 19 and 20 are connected between pivots 20P on the blades 15 and 16 and pivots 21 on the cowling 13 and supplied by hydraulic fluid via hydraulic control valve assembly 22 and hydraulic pump system 23, all as described in detail in the above-referenced Quenzi patent. The hydraulic pump switch assembly HPS has a switch HPS-1 for operating the lift cylinder(s) and left and right blade angle switches HPS-R, HPS-L.

Return springs 24, 25 are coupled between the cowling and each blade, respectively. The blades may be provided with cutting edges 26 and shoe assemblies 27 in a conventional fashion. A bank of trip springs 30 extends from the main horizontal pivot axis 31 (bearing bar 95) through a coupling plate 32 to a turnbuckle 33 which has hook end 35 which is connected to cowling 13. When one or both blades strike, for example, a speed bump in a parking lot, the blade or blades pivot about pivot axis 17 stretching springs 30 and when the obstacle is passed, the blades are returned to their normal position by the bank of trip springs 30. (Only one trip spring 30 is shown in FIG. 1.)

Switch SW-1 is electrically connected to control auxiliary lights LA on light bar assembly 116.

It will be appreciated that up to this point, the assembly as described is essentially fully disclosed in the above-referenced Quenzi patent, which is incorporated herein by reference.

THE PRESENT INVENTION

The preferred embodiment of the present invention includes the vehicle mount attachment frame or push beam assembly 50, the intermediate coupler frame assembly 40, the coupler slide plate assembly 41, coupler latch elements, and coupler latch handle and latch mechanism 42, and the hydraulic lift cylinder means, e.g. the pair of hydraulic lift cylinders 45L and 45R.

THE VEHICLE MOUNT ATTACHMENT (VMA):

The vehicle mount attachments push beam assembly 50 is provided with a pair of spaced latching sockets 51, 52, each of which is formed by a pair of diverging plates 55, 56 and 57, 58 which diverge and form guiding surfaces to account for horizontal misalignment during docking.

The vehicle mount attachment or push beam assembly is best illustrated in FIG. 2*a* and includes a main cross-beam member 60 having welded thereto socket forming plates 55, 56, 57 and 58, forming latching sockets 51 and 52, respectively, which have outwardly diverging ends 55-O, 56-O, 57-O and 58-O, which provide for some degree of horizontal misalignment as will be discussed more fully hereafter. The ends of beam 60 are provided with welded-on mounting plates 61, 62 which may be bolted to support plates 63, 64, respectively, which, in turn, are bolted or welded to the frame horns 65, 66 on both the passenger and driver side, respectively. In addition, a pair of angle brackets 67, 68 are bolted to the rearward ends of plates 56, 57 as indicated in FIG. 2*a*. The upper ends of angle brackets 67, 68 are bolted or otherwise welded to the frame horns 65, 66 on the passenger and driver side, respectively.

A latch bar 70 is mounted on the vertical mount attachment and extends transversely between socket-forming plates 55, 56, 57, 58, respectively.

The installation shown in FIG. 2*a* is in connection with one particular vehicle and it will be appreciated that since the undercarriage structure of various manufacturer's vehicles varies, the installation may vary from vehicle-to-vehicle but, the structure constituted by the vehicle mount attachment frame (VMA) 50 constituted by the latch bar and the socket assemblies described earlier herein is essentially the same for all arrangements.

In FIG. 2*b*, the driver's side frame horn 66 may be provided with an electrical quick disconnect mounting bracket 71 so that a common electrical cable carrying control signals from switch assembly HPS and power to the electric motor driving hydraulic pump assembly 23 and the lights LA mounted on a light-bar 72 (FIG. 1) can be easily and quickly made.

THE INTERMEDIATE SUPPORT FRAME

The intermediate support frame or coupler assembly 40 and its relation to the "T"-frame is best seen in FIG. 3*a*. The intermediate support frame is constituted by a pair of spaced steel plates 80, 81, which are joined by a tubular cross-bar frame member 82 and a clevis support cross-bar member 83, the ends of which are welded to respective plates 80, 81. Plates 80, 81 have rearwardly projecting latching arms 84, 85 on the upper surfaces of which are welded reaction bearing surfaces 86, 87. Latch dog housings 88, 89 are positioned above bearing surfaces 86, 87 to form a latching notch LN for receiving latch bar 70 (FIG. 2*a*). The edges of the rear or aft end of each latch dog housing are bevelled as at 88B and 89B to form camming surfaces for vertical alignment purposes, the ends 84E and 85E of the latching arms are also bevelled to assist in the vertical alignment process. A pair of spaced clevises 90, 91 are welded to frame member 83 and each receive the respective ends of hydraulic lift cylinders 45R and 45L, respectively, as shown in FIG. 1.

The trailing end of "T"-frame 10 is provided with rearwardly projecting parallel arms 92L, 92R, 93L and 93R, which have bearing apertures 94 through which passes the coupler pivot bearing bar 95 having arm 95A which is rotatably mounted in the plates 80, 81 of intermediate support frame 40 by bearing bosses 96 and 97. Horizontal bearing bar 95 passes through each of the bearing apertures 94 in rearwardly projecting arms 92L, 92R, 93L and 93R so as to rotatably mount the "T"-frame for rotation about a horizontal pivot axis and thus support the "T"-frame from the intermediate support frame.

"T"-frame 10 is provided with a cross-bar 98 which is welded on a lower part of the stem 99 of the "T"-frame and has a pair of rearwardly extending brace plates 100, 101 extending to the cross 102 of the "T". A pair of clevises 103, 104 is provided in the lateral ends of cross-bar 98 for receiving the rod ends of hydraulic motors 45R and 45L, respectively (see FIG. 1). The hydraulic cylinders or motors are supplied from a common port on the hydraulic valve assembly 22 and a hydraulic "T"-joint HT (FIG. 1) assures that equal hydraulic pressures are supplied to the two hydraulic motors or cylinders 45R and 45L to thereby pivot the "T"-frame about the horizontal axis constituted by bar 95.

A pair of latching dogs 105, 106 are fixedly secured to bar 95 by set screws 105S and 106S. As shown in FIG. 3*b*, the latching dogs are housed within latch-dog housings, latch dog 105 being shown within latch dog housing 88.

In the embodiment shown in FIG. 3*c*, the latch dogs have been replaced by a flexible cable operated pair of spring loaded or biased latch pins, one for each latch bar. Since they are identical, only one will be described. Latch housing 142 is generally "D"-shaped and welded to side plates 80, 81, the lower surface forming a down vertical alignment camming surface 142C which, in conjunction with up vertical alignment camming surface 85E' provides for vertical misalignments to assure seating of latch bar 70 in the latching notch LN'. Latch pins 143 are vertically reciprocated in aligned latch pin holes 144-1, 144-2 and 144-3 (the latter hole being in the bearing surface 85). A stop plate 145 limits the downward travel of latch pin 143 caused by spring 146. An attachment tab 147 is connected to flexible cable 148 which has the opposite end wound on a drum 149 and crank assembly 150, which is mounted between upright plate 110 and 111 but diagrammatically illustrated in FIG. 3*c* as for convenience of illustration.

As shown in FIG. 4, arm 95A is pivotally connected at its upper end to link 95L. The upper end of link 95L is pivotally connected to latch dog operating arm 95LDA which has a manually actuated handle 95MH. A pair of vertical upright plates 110, 111 are bolted to intermediate support frame side plates 80, 81 and have extending therebetween shelf 112 and back plate 113 which support electric pump and hydraulic assembly 23 and a control valve assembly 22. A change bracket assembly 115 carries lights assemblies 116 and 117. See FIG. 1. A hydraulic pump solenoid may also be mounted on the shelf. FIG. 6 illustrates the hydraulic system, per se.

The lower end of latch operating handle 95MH is pivotally mounted on upright plate 111 and the angular arrangement of the linkages 95LDH and 95L and operating arm 95A are such that when in the latch position for latch dogs 105, 106, the upper pivotal connection of link 95L to the intermediate point on the latch arm 95LDH is over-center to thereby maintain the dog in a latch position at all times. A coupler latch spring plunger 95-SP has an end 95E which enters latch hole 95-LH in vertical upright plate 111.

A cover plate 120C can be used to protect the hydraulic pump and hydraulic valve assembly from the elements.

FIG. 5 illustrates the assembly that is used to maintain the coupler power unit in light bar assembly and position relative to the "T"-frame when the plow is not on the truck so as to thereby maintain the rearwardly projecting arms in a position so that the unit can be quickly attached to a truck and not require operator intervention. In this arrangement, the horizontal pivot arrangement between the "T"-frame and the intermediate support frame or coupler assembly is provided with a coupler slide plate assembly 41 which includes a slide plate or bar 120 having a lower end pivotally supported on a pivot boss 121 on the end of the "T"-frame 10. A slot 122 is formed in plate 120. A pair of plastic washers (UHMW polyethylene or equivalent) is clamped to the inside and outside surfaces of the slide bar 120 by a threaded lug or stud 123 on upright plate assembly 110 (see FIG. 1). Hex nut 124 and a Belville washer 125 are tightened with sufficient force to hold the weight of the components when the plow is off the truck but, not so tight as to prevent lifting of the plow with the lift cylinders 45R, 45L. The clamping force is adjusted by means of the hex nut and Belville washer and holds the power unit and light bar assembly in position relative to the "T"-frame 10 when the plow is off of the truck.

FIG. 7 shows the plow aligned for quick coupling with the latch handle forward and the latch dogs 105, 106 up, so that the latching notch LN is open to receive horizontal latch bar 70. In FIG. 7, when the truck is driven slowly forward, any horizontal misalignment is corrected by the guide surfaces 55-O . . . 58-O (FIG. 2*a*) and any vertical misalignments will be corrected by camming surfaces 88B, 89B (too high) on the latch dog housing or the surfaces 84E, 85E (too low) on the latching arms 84 and 85, respectively. When the latch bar is seated in the pair of latch notches LN under each latch dog housing, a latching linkage is operated to rotate the dogs into locking position with the downward leg of each latch dog behind or aft of the latch bar 70. Spring pin 95E is biased into hole 95LH on plate 111 to positively lock the linkage in the position shown in FIG. 8.

Referring now to FIGS. 9*a*, 9*b* and 9*c*, are illustrations which demonstrate the positions of the reactive/reaction forces on the plow and truck. In FIGS. 9*a*, 9*b* and 9*c*, while the plow and "T"-frame and the intermediate coupling assembly are shown spaced from the truck frame mounting assembly, it will be appreciated that these views are shown just for purposes of illustration in that the forces occur only when the plow is mounted on a truck, namely, when the rearwardly projecting arms 84, 85 are engaged in sockets 51, 52. In FIG. 9*a*, when the plow is raised, as when the truck is moving from one location to another or stacking snow, the reaction forces on the intermediate frame member 40 are the two reaction forces F1, F2 and their equal opposite reaction forces are F3, F4, respectively. In conjunction with the two rearwardly projecting arms, the reaction forces on plates 86, 87 (the forces acting in the direction F2) are equal and opposite to the reaction forces on cross-beam 60 on the push-beam assembly 50. The equal and opposite reaction forces on the lower end of dog housings 88, 89 and the latching surfaces on latch dog 105, 106, e.g., the forces F1, and the equal and opposite reaction forces on latch bar 70 provided a very stable two point hitch assembly and, at the same time, provided for quick easy attachment with significant horizontal alignment features provided by the diverging outer plates 550, 560, 570 and 580 and vertical alignments caused by camming surfaces 84E, 85E and 88E and 89E with bearing bar 70. When plowing snow (FIG. 9*b*) the force applied by the cutting edge 26 and snow in the plow blades, per se, whether the plow blade is being pulled or pushed is delivered essentially to the latch bar 70 with the equal and opposite reaction forces F5, F6, F7, F8 being illustrated in FIG. 4*b*. When stacking snow as when force is applied on the cutting edge 26 in the direction indicated by the force FP', an equal and opposite reaction force will be applied between the latch dog and latch dog housing F9 and the latch bar F10 and the forward-most end of the push-beam assembly 50 and its guide plates 560 and 570 will have the reaction force F11 which is equal and opposite to the reaction force F12 on the intermediate frame member 40.

CENTRALLY LOCATED LIFT CYLINDER EMBODIMENT

As shown in FIG. 10, a single centrally located chain lift cylinder may be used to lift the "T"-frame for transport and other purposes. In this embodiment a further cross-bar 130 is weld mounted between vertical uprights 110 and 111 and carries a central clevis 131 for pivotally supporting the lower end of centrally positioned hydraulic cylinder or motor 132. The light assembly cross-bar 133 also has a centrally located clevis 134 for pivotally receiving the end of lift arm 135. The outer end of lift arm 135 pivotally receives the upper or piston arm end 138 of hydraulic cylinder 132 at pivot 136. A chain 138 is hooked on the outermost end of left arm 135 and is coupled to the "T"-frame support frame 10' and operates in essentially the same fashion as disclosed in the aforementioned Quenzi patent.

While preferred embodiments of the invention have been shown and described, it will be appreciated that numerous modifications and adaptations will be readily apparent to those skilled in the art and embraced by the claims appended hereto.

What is claimed is:

1. A quick hitch-unhitch attachment for mounting a snow working implement on a vehicle, comprising:

a vehicle mount attachment (VMA) frame having means for securing said VMA frame to said vehicle and a pair of spaced sockets which are positioned below the vehicle bumper when mounted on said vehicle, a first pair of reaction bearing surfaces aligned with and to the rear of said spaced sockets and a transverse latch bar means extending transversely of said sockets, an intermediate frame, said intermediate frame having a rearward end with a pair of latching arms extending in a rearward direction and in general alignment with said sockets, respectively, each said latching arm having a further reaction bearing surface for bearing against respective ones of said first pair of reaction bearing surfaces, a support frame having a forward end attached to said snow working implement and a rearward end pivotally connected to said intermediate frame for rotation about a horizontal axis, a latching mechanism on said intermediate frame for positioning a latch member rearwardly of said transverse latch bar means in each of said spaced sockets, respectively, and below said bumper, and a lift mechanism on said intermediate frame for pivoting said support frame about said horizontal axis and for lifting said support frame and working implement off the ground such that the weight thereof is borne by said reaction bearing surfaces and said pair of spaced socket means.

2. The invention defined in claim 1 wherein said lift mechanism comprises at least a pair of spaced apart hydraulic cylinders.

3. The invention defined in claim 1 wherein said lift mechanism includes a central lift tower, a hydraulic cylinder secured at one end to said lift tower and at an opposite end to said support frame.

4. The invention defined in claim 1 wherein said latching mechanism includes an over center toggle linkage.

5. The invention defined in any one of claims 1–4 including means for maintaining the angular relationship between said intermediate frame and said support frame when said intermediate support frame is not coupled to said VMA frame.

6. A small truck snow plow mount comprising an attachment frame adapted to be mounted on said small truck behind and below the forward-most surface of a vehicle bumper, said attachment frame having a pair of attachment sockets having side plates which converge to a latching position, and transverse latch bar means, an intermediate attachment frame having latching arm means guidable to said latching position in said pair of attachment sockets, respectively, by said side plates which converge, latch means on said intermediate attachment frame for latching said intermediate frame to said transverse latch bar means in both said sockets, a snow plow support frame and means pivotally supporting said snow plow frame from said intermediate attachment frame and means for lifting said snow plow frame and pivot said snow plow frame about said horizontal pivot.

7. The invention defined in claim 6 wherein said means for lifting includes one or more hydraulic cylinders coupled to a source of hydraulic fluid under pressure.

8. The invention defined in claim 7 wherein there are two hydraulic lift cylinders coupled from the sides of said intermediate attachment frame to the sides of said snow plow frame.

9. The invention defined in claim 8 wherein said hydraulic cylinders are double acting and adapted to apply force to a snow plow in a downward direction.

10. A bumpered vehicle snow plow mount comprising an attachment frame means adapted to be mounted on said bumpered vehicle below the forward-most surface of said bumpered vehicle, a latch bar mounted on said attachment frame means, an intermediate attachment frame having latching arm means guidable to a latching position by said attachment frame means a pair of latch dogs, a latch dog operator for simultaneously operating said each latch dog to a position behind said latch bar, a snow plow support frame and horizontal pivot means pivotally supporting said snow plow support frame from said intermediate attachment frame and means for lifting said snow plow frame and pivot said snow plow frame about said horizontal pivot means.

11. The invention defined in claim 10 wherein said latching arm means includes camming surfaces engageable by said latch bar to cam said intermediate frame member in a vertical direction to account for vertical misalignment of latching arms from said latching position.

12. The invention defined in claim 10 wherein said means for lifting includes one or more hydraulic cylinders coupled to a source of hydraulic fluid under pressure.

13. The invention defined in claim 12 wherein there are two hydraulic lift cylinders coupled from the sides of said intermediate attachment frame to the sides of said snow plow frame.

14. The invention defined in claim 13 wherein said hydraulic cylinders are double acting and adapted to apply force to a snow plow in a downward direction.

15. The invention defined in claim 10 wherein said latch dog operator includes a bar and an operating arm for rotating said bar, means fixedly securing said latch dogs to said bar so that said latch dogs can be operated simultaneously on rotation of said operating arm.

16. The invention defined in claim 15 wherein each said latch dog includes a latch dog housing.

* * * * *